United States Patent [19]

Roethel et al.

[11] Patent Number: 4,938,386

[45] Date of Patent: Jul. 3, 1990

[54] CUP TRIP ASSEMBLY

[75] Inventors: Henry G. Roethel; James P. Leigh, both of Ravenna, Ohio

[73] Assignee: The Meyer Company, Cleveland, Ohio

[21] Appl. No.: 298,021

[22] Filed: Jan. 18, 1989

[51] Int. Cl.[5] ..... B65D 47/08

[52] U.S. Cl. ..... 222/92; 222/105; 222/505; 141/360; 251/228

[58] Field of Search ..... 222/96, 105, 153, 212–213, 222/498, 501, 505, 509, 517, 545–546, 556; 137/320–323; 251/228–229, 231, 236, 243–244, 2; 141/354, 357, 360, 362

[56] References Cited

U.S. PATENT DOCUMENTS

| | | | |
|---|---|---|---|
| 3,315,516 | 4/1967 | Peterson | 251/144 |
| 3,372,841 | 3/1968 | Olson | 222/505 |
| 3,376,582 | 4/1968 | Samuels | 222/509 X |
| 3,696,969 | 10/1972 | De Van et al. | 222/183 X |
| 3,972,452 | 8/1976 | Welsh | 222/501 |
| 4,138,092 | 2/1979 | Apellaniz | 251/325 |
| 4,169,548 | 10/1979 | Bond | 222/505 |

*Primary Examiner*—Michael S. Huppert

*Attorney, Agent, or Firm*—Fay, Sharpe, Beall, Fagan, Minnich & McKee

[57] ABSTRACT

A cup trip assembly is disclosed for use on bag-in-the-box and membrane type beverage containers of the type having an outlet nozzle with a manually operable dispensing valve carried at the end thereof. The cup trip assembly comprises a mounting collar adapted to releasably encircle and lock to the nozzle at a location adjacent the dispensing valve. A transversely extending operating member is pivotally carried by the mounting collar at a location axially outward of the nozzle. The operating member has operating fingers extending rearwardly therefrom for engagement with the dispensing valve for moving the valve to an open position when the operating member is rotated in a first direction and moving the valve to a closed position when the operating member is rotated in a second direction. A cup trip lever is joined to and depends from the operating member to a position subjacent the dispensing valve where movement of a cup to a beverage receiving position beneath the dispensing valve causes movement of the cup trip lever to rotate the operating member in the first direction.

14 Claims, 2 Drawing Sheets

CUP TRIP ASSEMBLY

BACKGROUND OF THE INVENTION

The subject invention is directed toward the dispensing art and, more particularly, to an assembly for operating a dispensing valve when a cup or similar beverage receiving container is moved to a receiving position beneath the valve.

The assembly of the invention is especially suited for use with bag-in-the-box or membrane type beverage containers and will be described with reference thereto; however, as will become apparent, the invention is capable of broader application and could be used in association with many different types of fluid storage containers.

Membrane or plastic bag type containers are in widespread use for storing and dispensing a large variety of fluids including beverages. Typically, the containers include a rigid, cylindrical discharge nozzle which extends through a side wall of the container closely adjacent the bottom. Normally, relatively simple molded plastic dispensing valves are fitted to the ends of the nozzles. The valves are generally operated by a simple tab-type handle which moves the valve open with a tilting movement.

Valves of the general type under consideration are shown, for example, in U.S. Pat. Nos. 3,400,866, 3,443,728, 3,972,452, 4,169,548, and 4,711,380. As shown therein, the operating handles or tabs generally extend outwardly and move the valve open with a simple upward tilt. Normally, the valves snap to a closed position when the operating tab is released. Consequently, the valves cannot generally be left in the open position but must be manually held to produce continuing flow.

When the containers and dispensing valves described above are used for dispensing beverages the beverage receiving cup or glass must be held beneath the nozzle with one hand while a continual valve opening force is applied with the other.

The subject invention provides a very simple cup trip assembly which can be used with dispensing nozzles and valves of the type described to permit one handed control of the dispensing operation. More particularly, the cup trip assembly of the invention maintains the dispensing valve in a full open position so long as the cup or glass is in a beverage receiving position.

BRIEF SUMMARY OF THE INVENTION

In accordance with the invention, a cup trip assembly is provided for use with membrane type beverage containers of the type having a bottom wall and an upwardly extending continuous side wall. A discharge nozzle extending from the side wall of the container carries a manually operable dispensing valve of the type wherein opening movement is produced by an outwardly extending valve operating handle or tab. The cup trip assembly of the invention is joined to the nozzle for producing tilting movement of the operating handle to move the valve to an open position when a cup or the like is moved into a beverage receiving position beneath the nozzle. The cup trip assembly comprises a mounting collar encircling and joined to the nozzle at a location adjacent the dispensing valve. A transversely extending operating member is pivotally carried by the mounting collar at a location axially outward of the nozzle and the dispensing valve. The operating member includes an operating means which extends rearwardly into engagement with the valve operating handle to move the handle to a valve opening position when the operating member is rotated in a first direction. A cup trip lever is joined to and depends from the operating member to a position subjacent the nozzle where movement of a cup to a receiving position beneath the dispensing valve requires movement of the cup trip lever to produce rotation of the operating lever in the first direction.

In accordance with a further aspect of the invention, a stop means depends from the lower portion of the collar to limit rearward movement of a cup positioned beneath the dispensing valve and to prevent movement of the bag or beverage container rearwardly when a cup is moved into position to operate the cup trip lever.

A more limited aspect of the invention is that the mounting collar is releasably connected to the nozzle and comprises a generally circular body having overlapping ends joined by adjustable connecting means. This permits the cup trip assembly to be joined to nozzles having different diameters and to firmly engage with a variety of different nozzle sizes.

Preferably, and in accordance with a more limited aspect of the invention, the mounting collar includes outwardly extending finger tabs which permit manual engagement of the mounting collar to produce firm connection of the overlapping ends.

As can be appreciated from the foregoing, the cup trip assembly of the subject invention can be readily installed and removed from a variety of bag-in-the-box type dispensing containers. Moreover, when installed on an outlet nozzle a simple movement of a cup to a receiving position beneath the nozzle causes actuation of the valve to an open position. The cup stop member limits the movement so that the valve operating lever is in a position wherein release of the force on the cup trip lever causes the valve to snap to a closed position.

In accordance with a further and more limited aspect of the invention the cup trip assembly can be a simple injection molded plastic part. In addition, the adjustable collar can include ratchet type connecting means so that both installation and removal do not require any special tools or the like.

As can be seen from the foregoing a primary object of the subject invention is the provision of an extremely simple cup trip mechanism which can be used with bag-in-the-box and membrane type beverage dispensing containers.

A further object of the invention is the provision of a mechanism which can be applied to conventional beverage containers to permit one handed dispensing operation.

A still further object is the provision of an apparatus of the type described which is extremely simple to manufacture, install, and operate.

BRIEF DESCRIPTION OF THE DRAWINGS

The above and other objects and advantages will become apparent from the following description when read in conjunction with the accompanying drawings wherein:

Referring more particularly to the drawings wherein the showings are for the purpose of illustrating a preferred embodiment of the invention only, and not for the purpose of limiting same, FIG. 1 shows the general overall arrangement of a cup trip assembly 10 mounted on a beverage bag and outlet nozzle assembly 12. In the FIG. 1 showing the beverage container is illustrated as resting on a table or counter top 14. The beverage container and nozzle assembly 12 includes a flexible beverage bag 16 formed from plastic sheet and having continuous side walls 18 and a generally transversely extending bottom wall 20. A molded plastic outlet nozzle 22 has a generally cylindrical configuration and extends through the bag wall 18 adjacent the bottom wall 20. A reinforcing flange member 24 extends circumferentially about inner end of the nozzle and is suitably clamped to the bag side wall 18 by an internal flange and reinforcing disc 26. The nozzle 22 is generally cylindrical in configuration and has an internal flow passage 28 formed therethrough. Suitable exteriorly formed radial flanges 30 and 32 extend outwardly from the exterior of the nozzle 22 to permit attachment of valves and/or related dispensing apparatus.

The structure thus far described is relatively conventional and is given merely as one possible embodiment of membrane type beverage bag with which the subject invention could be used. It should be appreciated that a variety of other types of bags, including those housed in corrugated cardboard containers, have the same general overall arrangement of dispensing nozzle assembly and bag structure.

Figure 4:
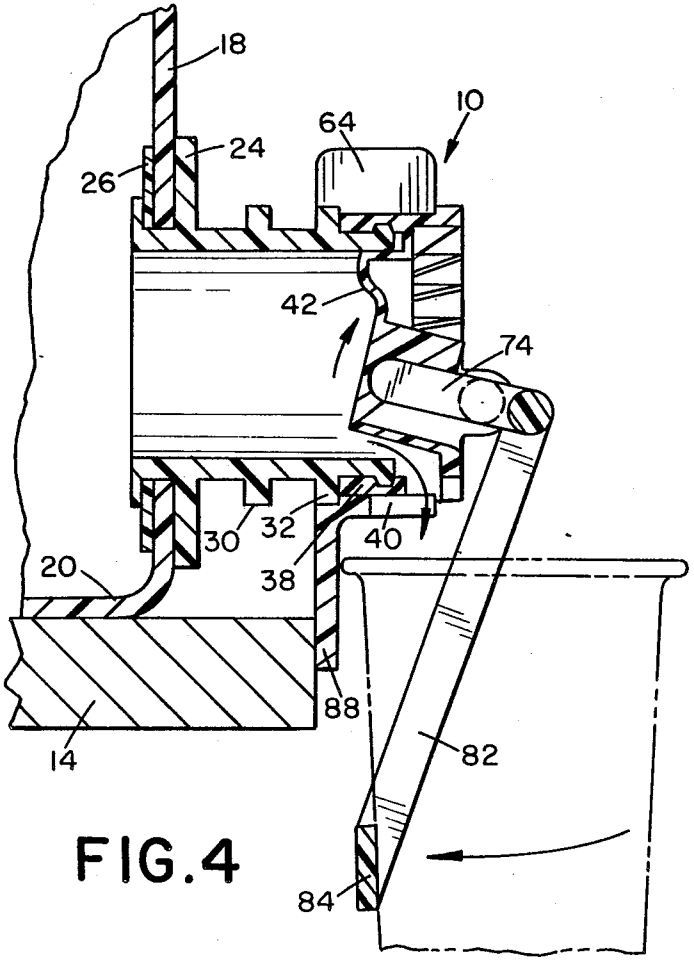
FIG. 4 is a view like FIG. 1 but showing the valve in an open position with a beverage receiving cup or glass in position beneath the outlet nozzle.

Associated with the nozzle 22 and resiliently and tightly joined to the outer end thereof is a dispensing valve 34. The valve 34 illustrated herein is generally typical of a variety of similar valves which are widely used for dispensing fluids from bag-in-the-box and membrane type beverage containers. Examples of these valves are shown in the above-noted prior art patents. Typically, the valves include a generally cylindrical outer body 36 having a rearwardly extending flange or collar section 38 which is adapted to closely and tightly encircle the outer free end of the nozzle 22. Adjacent the lower or bottom section of the valve 34 is an outlet opening 40. Flow from the interior of the bag and the nozzle 22 passes through the outlet 40 and is controlled by a generally cup-shaped valve member 42 formed from a resilient, resinous plastic material. Typically, the cup-shaped valve member and the outer cylindrical body or housing of the valve is formed as a unitary structure through an injection molding process. The cup-shaped valve member 42 is sized so as to extend into the interior of the nozzle outlet passage 28. The peripheral edge of the cup-shaped member 42 sealingly engages about the interior of the passage 28 to prevent flow to the outlet 40. Generally, the member 42 will include an outwardly extending operating handle or tab element 44 which is molded integrally therewith. As best seen in FIG. 4, upward tilting movements applied to the handle or tab 44 causes the lower peripheral portion of the valve member 42 to deflect away from the interior of the outlet nozzle 28 and permit flow to take place through the outlet 40. The natural resiliency of the cup-shaped member 42 and its structural configuration causes it to snap to a closed position when force is removed from the tab 44. Accordingly, as can be appreciated, when it is desired to dispense fluid into a cup or glass positioned beneath the outlet 40 it is necessary to maintain the tab in the upward tilted position. Consequently, both hands must be used to dispense fluid. That is, one hand must be used to hold the cup or glass while the other hand is used to deflect the operating tab. Although some of the valve assemblies can be moved to an over-center position wherein the valve will remain open, typically release of the handle allows the valve to automatically close.

As previously discussed, the cup trip assembly of the subject invention overcomes the noted problems and facilitates beverage dispensing. The preferred arrangement of the cup trip assembly of the invention can best be seen from FIGS. 2 and 3. As shown therein, the assembly 10 includes a first body member in the form of a cylindrical collar 50 which is sized to encircle the exterior of the nozzle 28 and the collar 38 of the dispensing valve 34. The cylindrical collar 50 has overlapping free end portions 52 and 54 provided with respective engaging teeth sections 56 and 58. A pair of outwardly extending finger tabs 62 and 64 are positioned such that the overlapping free ends 52 and 54 can be driven together into adjusted interlocking position to tightly grip about the nozzle and valve assembly in the position shown in FIG. 1. The cylindrical collar section 50 can, of course, be released from its engaged position by pinching the finger tab 62, 64 toward one another while lifting on the free end 52 to disengage the teeth 56, 58.

Figure 2:
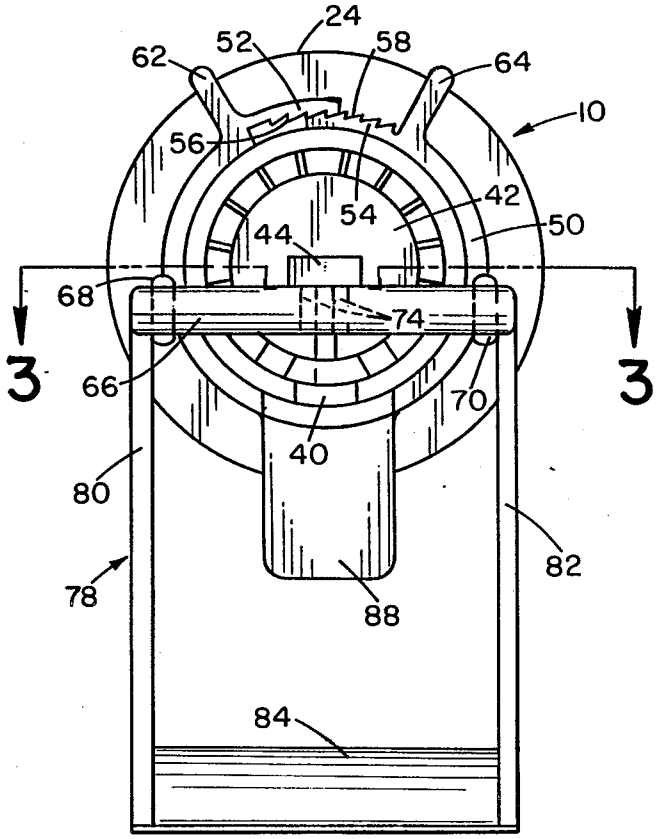
FIG. 2 is a front elevational view of the nozzle and cup trip assembly shown in FIG. 1 (the view is taken on line 2—2 of FIG. 1)
Figure 3:
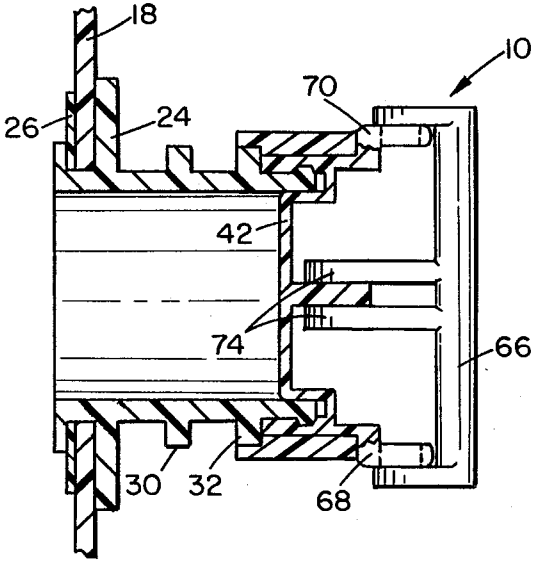
FIG. 3 is a cross-sectional view taken on line 3—3 of FIG. 2.

Extending transversely relative to the collar 50 and adjacent the outer end of valve 34 is an operating member 66. The operating member 66 is pivotally connected to the collar 50. As shown in FIGS. 2 and 3, a pair of leg-like portions 68 and 70 extend outwardly from the collar section 50. Pivot pins 72 are carried by operating member 66 and extend through suitable pivot openings formed in members 68 and 70. Extending rearwardly from the central section of operating member 66 are means adapted to move the valve operating handle or tab 44 in an opened direction upon rotation of the operating member 66. Specifically, these means comprise a pair of spaced fingers or levers 74 which are formed integral with operating member 66 and have a length so as to extend rearwardly beneath the operating handle or tab 44. In the embodiment under consideration, a reinforcing web 76 is connecting between the underside of the handle tab 44 and the outer face of the cup-shaped valve element 42. The spaced apart nature of the fingers 74 allow them to engage snugly on opposite sides of this reinforcing web. Similar or slightly different arrangements could be used depending upon the particular valve operating member provided on the discharge valve.

The means for rotating the operating member 66 could take many forms but, in the subject embodiment, comprise a cup trip lever assembly 78 which includes a pair of spaced legs 80, 82 joined to the ends of the operating member 66. Preferably, the operating member 66 and the legs 82 are integrally molded to provide a rigid, one piece structure. The lower ends of the legs 80 and 82 are provided with a transversely extending cup engaging member 84. Member 84 is also preferably molded integrally with the legs 80 and 82.

Figure 1:
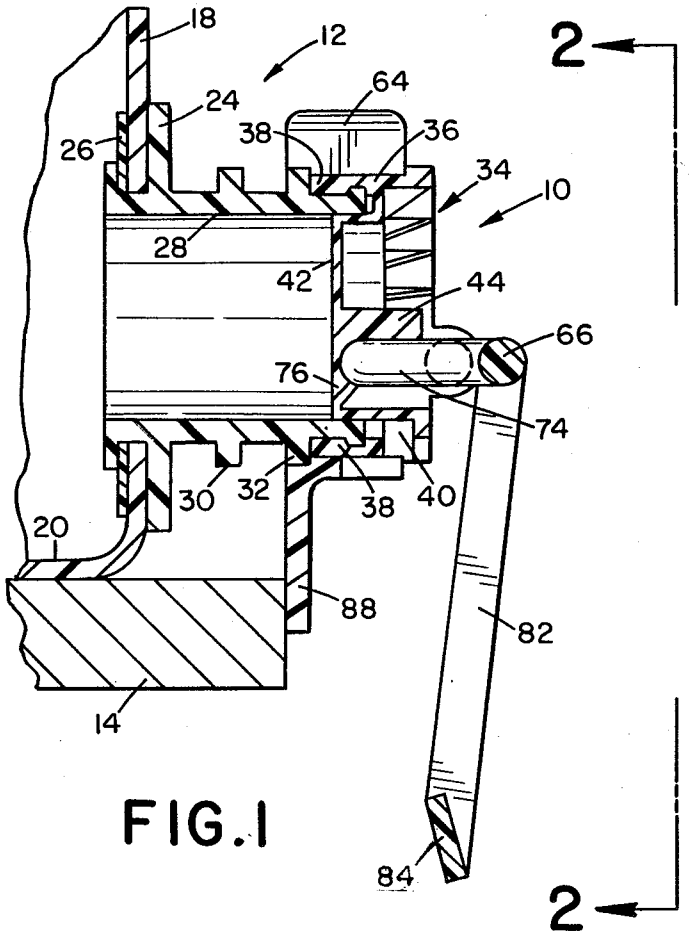
FIG. 1 is a partial side elevational view of a bag or membrane type beverage container and dispensing nozzle having installed thereon a cup trip assembly formed in accordance with the preferred embodiment of the invention.

As best shown in FIGS. 1 and 4, the positioning of the cup trip lever assembly 78 is such that when a cup is brought into fluid receiving position beneath the discharge nozzle 34, the cup trip lever must be rotated as shown by the arrows to the position illustrated in FIG. 4. When in this position, the operating means 74 has rotated the valve operating handle or tilted it to the position of FIG. 4 wherein flow can take place through the outlet 40. Flow continues as long as the cup is in this fluid receiving position. However, when the cup is removed, the natural resiliency of the valve element causes it to snap back and return the cup trip mechanism to the position shown in FIG. 1.

Associated with the collar member 50 is a cup stop member 88. As shown, member 88 comprises a rigid tab or finger which extends directly downward from the underside of the collar 50. The length of member 88 is such as to extend beneath the bottom wall 20 of the associated beverage bag 16. Thus, the member 88 can act to engage the outer edge of the table or counter 14 on which the bag rests so as to prevent the bag from being moved rearwardly as the cup trip lever is engaged. Additionally the position of the member 88 allows it to serve as a cup stop to prevent over movement of the trip lever assembly 78. That is, the member 88 engages the edge of the cup to prevent further rearward movement beyond the normal discharge position.

As can be appreciated from the foregoing, the subject invention provides an extremely simple structure which allows one handed operation of the conventional beverage bag valve. In addition, the assembly is such that it can be quickly removed and applied to subsequent beverage bag assemblies and does not have to be discarded when the empty beverage bag is thrown away.

Obviously, alterations and modifications of the preferred embodiment will occur to others upon a reading and understanding of the subject specification. It is intended to include all such modifications and alterations as part of the invention insofar as they come within the scope of the appended claims.

What is claimed is:

1. A cup trip assembly for sue on bag-in-the-box and membrane type beverage containers having an outlet nozzle with a manually operable dispensing valve carried at the end thereof; said cup trip assembly comprising:

a mounting collar including engaging positions adapted to encircle and releasably lock to said nozzle for support therefrom at a location adjacent said dispensing valve;

an operating member carried by said mounting collar at a location axially outwardly of said nozzle in general alignment with said nozzle, said operating member mounted for rotation about an axis transverse to said mounting collar and having an operating means extending rearwardly therefrom for engagement with said dispensing valve for moving said valve to an open position when said operating member is rotated in a first direction and permitting said valve to move to a closed position when said operating member is rotated in a second direction; and a cup trip lever joined to and depending from said operating member to a position subjacent said dispensing valve where movement of a cup to a receiving position beneath said dispensing valve causes movement of said cup trip lever to rotate said operating member in said first direction.

2. The cup trip assembly of claim 1 wherein a stop means extends downwardly from said collar for limiting movement of cups rearwardly to limit the movement imparted to said cup trip lever.

3. The cup trip assembly of claim 1 wherein said cup trip lever is of generally U-shaped configuration and comprises a pair of upwardly extending legs joined at their upper ends to said transversely extending operating member.

4. The cup trip assembly of claim 1 wherein said mounting collar includes adjustable means for permitting it to encircle and lock to outlet nozzles of differing diameters.

5. The cup trip assembly of claim 2 wherein said stop means extends downwardly a distance to be below the bottom of a beverage bag associated therewith.

6. The cup trip assembly of claim 3 wherein said cup trip lever is formed integrally with said operating member.

7. A cup trip assembly for use on bag-in-the-box and membrane type beverage containers having an outlet nozzle with a manually operable dispensing valve carried at the end thereof; said cup trip assembly comprising:

a mounting collar adapted to releasably encircle and lock to said nozzle at a location adjacent said dispensing valve;

an operating member pivotally carried by said mounting collar at a location axially outwardly of said nozzle and extending transversely thereof, said operating member having an operating means extending rearwardly therefrom for engagement with said dispensing valve for moving said valve to an open position when said operating member is rotated in a first direction and permitting said valve to move to a closed position when said operating member is rotated in a second direction; and, a cup trip lever joined to and depending from said operating member to a position subjacent said dispensing valve where movement of a cup to a receiving position beneath said dispensing valve causes movement of said cup trip lever to rotate said operating member in said first direction.

8. A cup trip assembly for use on bag-in-the-box and membrane type beverage containers having an outlet nozzle with a manually operable dispensing valve carried at the end thereof; said cup trip assembly comprising:

a mounting collar adapted to releasably encircle and lock to said nozzle at a location adjacent said dispensing valve;

an operating member pivotally carried by said mounting collar at a location axially outwardly of said nozzle and extending transversely thereof, said operating member having an operating means extending rearwardly therefrom for engagement with said dispensing valve for moving said valve to an open position when said operating member is rotated in a first direction and permitting said valve to move to a closed position when said operating member is rotated in a second direction;

a cup trip lever joined to and depending from said operating member to a position subjacent said dispensing valve where movement of a cup to a receiving position beneath said dispensing valve causes movement of said cup trip lever to rotate said operating member in said first direction; and a stop means extending downwardly from said collar a distance to be below the bottom of a beverage bag associated therewith for limiting movement of cups rearwarding to limit the movement imparted to said cup trip lever.

9. In combination:

a membrane type beverage container having a bottom wall and upwardly extending continuous side walls;

a discharge nozzle extending from a side wall adjacent the bottom wall;

a manually operable dispensing valve carried in the end of said nozzle, said valve being of the type wherein opening of said valve is produced by movement of an outwardly extending operating handle;

a cup trip assembly joined to said nozzle for producing tilting movement of said operating handle to move said valve to an open position when a cup or the like is moved into a beverage receiving position beneath said nozzle, said cup trip assembly comprising:

a mounting collar encircling and joined to said nozzle at a location adjacent said dispensing valve;

an operating member pivotally carried by said mounting collar at a location axially outwardly of said nozzle and said dispensing valve, said operating member extending transversely of said mounting collar and including an operating means extending rearwardly therefrom into engagement with said valve operating handle for moving said operating handle to a valve opening position when said operating member is rotated in a first direction;

a cup trip lever joined to and depending from said operating member to a position subjacent said nozzle wherein movement of a cup to a receiving position beneath said dispensing valve requires movement of said cup trip lever to rotate said operating member in said first direction; and, a stop means depending from said collar for limiting rearward movement of a cup positioned beneath said dispensing valve, said stop means comprising a rigid finger member extending downwardly to a position beneath the level of the bottom wall of said beverage container.

10. The combination as defined in claim 9 wherein said mounting collar is releasably connected to said nozzle and comprises a generally circular body having overlapping ends joined by adjustable connecting means.

11. The combination as defined in claim 10 wherein said mounting collar includes finger tabs extending outwardly from the ends of said circular body for adjusting the relative positions of said ends.

12. The combination as defined in claim 9 wherein said cup trip lever includes a pair of downwardly extending spaced leg portions joined at their lower ends by a transversely extending member.

13. The combination as defined in claim 12 wherein the upper ends of said leg portions are joined to said operating member.

14. The combination as defined in claim 9 wherein said cup trip lever depends from the ends of said operating member and is rigidly connected thereto such that rotary movement of said cup trip lever produces rotary movement of said operating member.

* * * * *